US011353248B2

(12) United States Patent
Sung

(10) Patent No.: US 11,353,248 B2
(45) Date of Patent: Jun. 7, 2022

(54) REFRIGERATOR

(71) Applicant: LG ELECTRONICS INC., Seoul (KR)

(72) Inventor: Chiun Sung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 142 days.

(21) Appl. No.: 16/836,303

(22) Filed: Mar. 31, 2020

(65) Prior Publication Data

US 2020/0318871 A1 Oct. 8, 2020

(30) Foreign Application Priority Data

Apr. 3, 2019 (KR) ..... 10-2019-0039076

(51) Int. Cl.
*F25B 39/04* (2006.01)
*F25D 19/00* (2006.01)

(52) U.S. Cl.
CPC ..... *F25B 39/04* (2013.01); *F25D 19/00* (2013.01); *F25B 2339/043* (2013.01); *F25B 2339/045* (2013.01)

(58) Field of Classification Search
CPC ..... F25D 19/00; F25D 23/006; F25D 2323/00284; F25D 23/003; F25B 2339/043; F25B 2339/045
See application file for complete search history.

(56) References Cited

U.S. PATENT DOCUMENTS

2016/0069595 A1* 3/2016 Kim ..... F25D 23/003 62/498

FOREIGN PATENT DOCUMENTS

| | | |
|---|---|---|
| CN | 106871498 | 6/2017 |
| EP | 2 993 427 | 3/2016 |
| KR | 10-2016-0029636 | 3/2016 |

OTHER PUBLICATIONS

European Search Report dated Aug. 19, 2020 issued in EP Application No. 20167695.4.
European Search Report dated Aug. 19, 2020 issued in EP Application No. 20167695.4 (previously provided).

* cited by examiner

*Primary Examiner* — Lionel Nouketcha
(74) *Attorney, Agent, or Firm* — KED & Associates, LLP

(57) ABSTRACT

A refrigerator includes: a cabinet for defining a storage space and a machine room; a compressor disposed in the machine room; a machine room cover for shielding a machine room opening; a base pan in the machine room; a condenser including: headers mounted on the base pan and extending to intersect the base pan; a plurality of tubes connecting the headers; and heat exchange fins disposed between adjacent tubes; and fixing parts protruding upward from the base pan and fixing the condenser by restraining a lower end of each header, wherein insertion holes opened toward the machine room opening are defined in the fixing parts, wherein the condenser is able to move to pass through the machine room opening, and wherein the lower end of each header is inserted and mounted into each insertion hole and is separated by exiting each insertion hole by the movement of the condenser.

20 Claims, 12 Drawing Sheets

REFRIGERATOR

CROSS-REFERENCE TO RELATED APPLICATION

This application claims priority under 35 U.S.C. § 119 to Korean Application No. 10-2019-0039076 filed on Apr. 3, 2019, whose entire disclosure is hereby incorporated by reference.

BACKGROUND

1. Field

The present disclosure relates to a refrigerator.

2. Background

In general, a refrigerator is a home appliance for storing foods at a low temperature in an internal storage space shielded by a door. To this end, the refrigerator uses cold-air generated through heat exchange with a refrigerant circulating a refrigeration cycle to cool an interior of the storage space, so that the stored foods may be stored in an optimal state.

In a structure of a general refrigerator, a machine room in which components such as a compressor, a condenser, and the like for driving the refrigeration cycle are arranged may be provided separately from the storage space. In one example, in a case of the machine room, an interior space is empty, and a plurality of flow passage of cooling air may be formed for cooling of the components inside the machine room.

The machine room is a space separate from the storage space in the refrigerator. As a volume of the machine room increases, a volume of the storage space in the refrigerator decreases. Therefore, various technologies for minimizing the space of the machine room have been developed. For example, technologies for reducing sizes of a compressor and a condenser while maintaining a required performance by improving efficiencies of the compressor and the condenser have been developed.

Korean Patent Publication No. 10-2016-0029636 discusses a machine room and a structure in which a condenser is mounted inside the machine room. In particular, a refrigerator that may efficiently utilize a space inside the machine room using a parallel flow condenser with bent one side is disclosed. However, in the reference, although a small condenser with an improved efficiency is used, a scheme of mounting the condenser is a scheme in which the condenser is mounted while moving downward.

Therefore, in such scheme of mounting the condenser, a space defined in a vertical direction having a size equal to a moving distance of the condenser in the vertical direction is required, and an additional space above the condenser is further required in a service situation for repair or maintenance of the condenser or the machine room. That is, the additional space should be defined above the condenser in the machine room in consideration of assembly and installation and the service, which results in loss of the storage space.

The above reference is incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
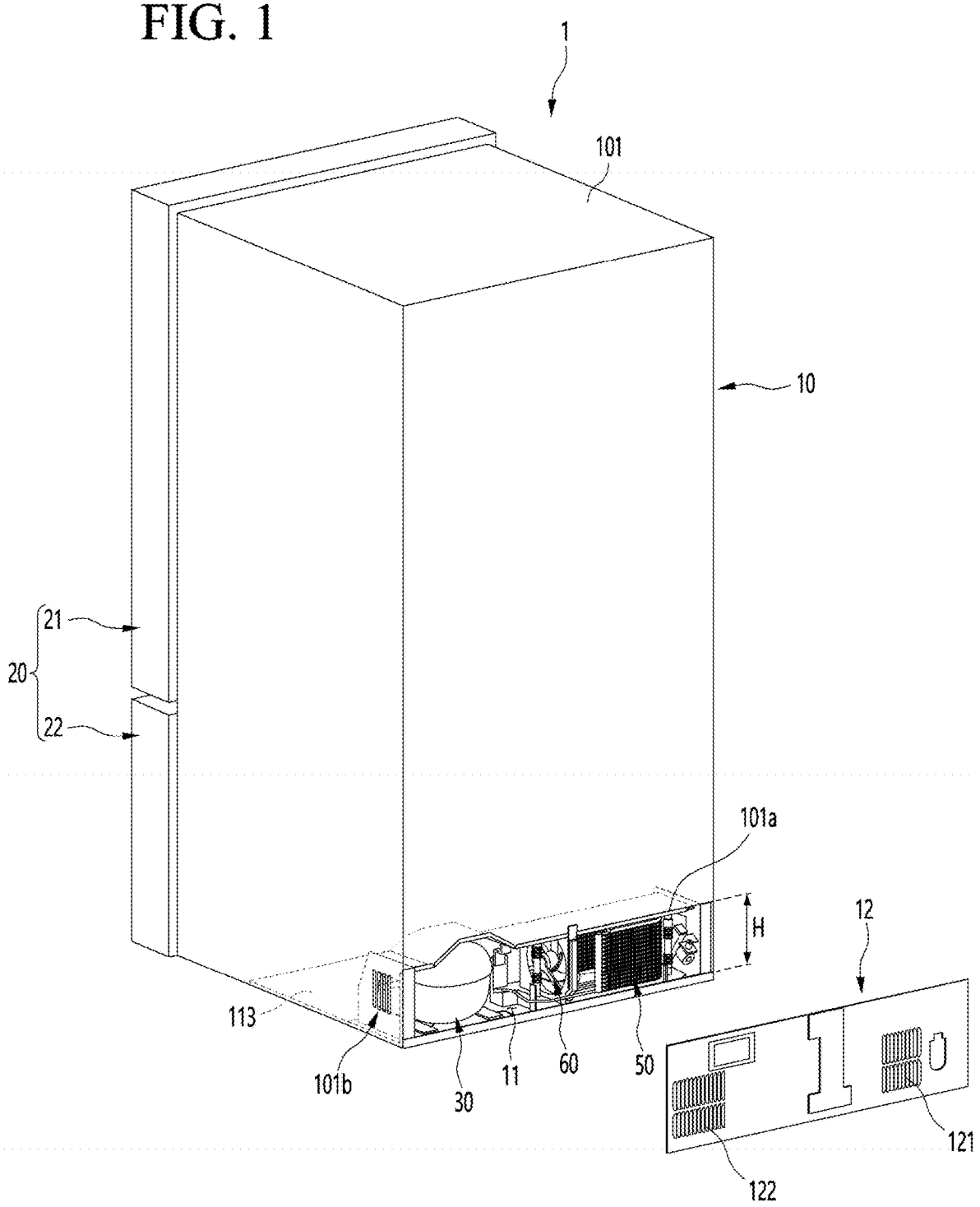
FIG. 1 is a perspective view illustrating a state in which a machine room at a rear face of a refrigerator according to an embodiment of the present disclosure is opened.
Figure 2:
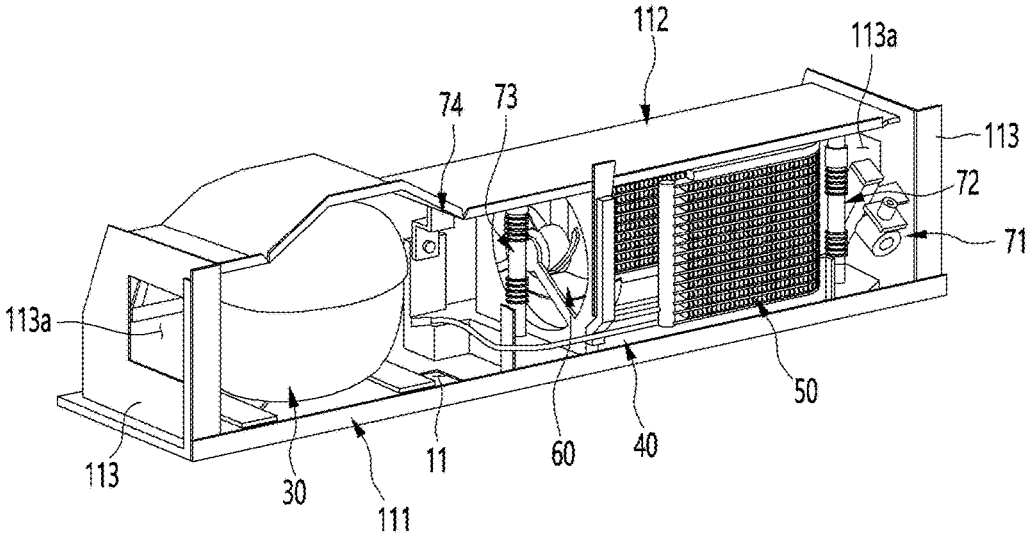
FIG. 2 is a perspective view illustrating an internal structure of the machine room.
Figure 3:
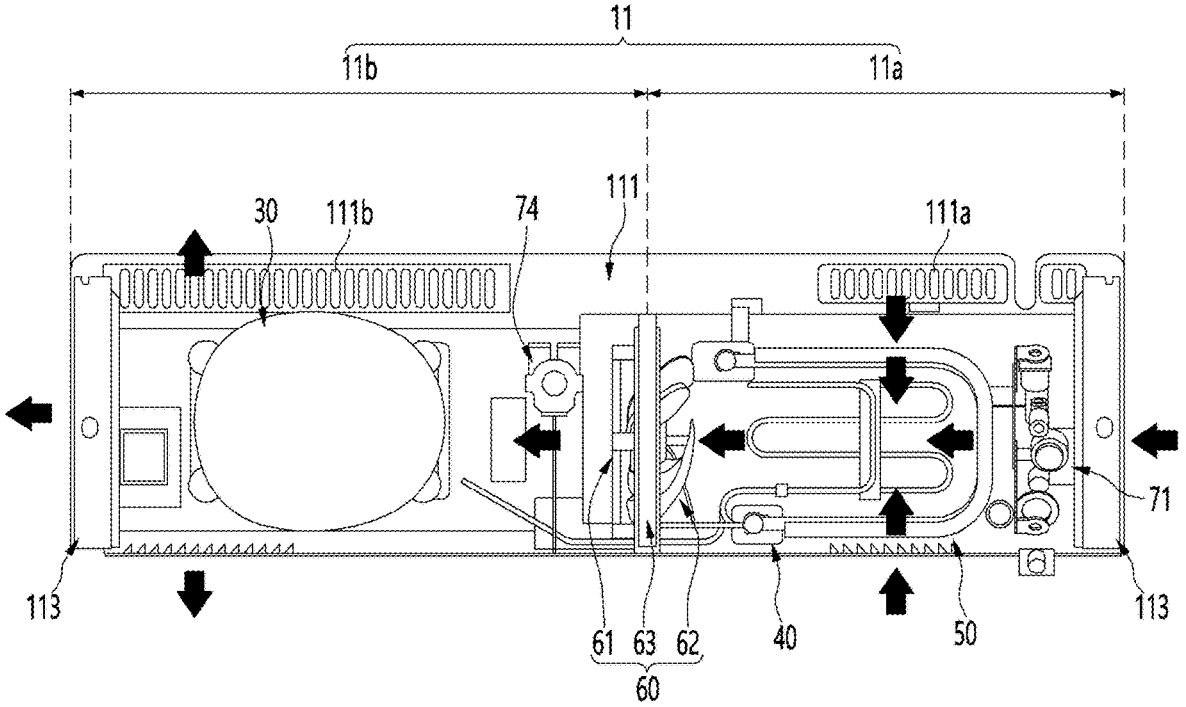
FIG. 3 is a plan view illustrating an air flow state of the machine room.

In FIGS. 1-3, hereinafter, for convenience of understanding of the description, a direction toward a door 20 will be defined as a forward direction, and a direction toward a machine room cover 12 that shields a machine room opening 101*a* will be defined as a rearward direction.

As shown in the drawing, a refrigerator 1 according to an embodiment of the present disclosure may include a cabinet 10 defining a storage space therein and a door 20 for opening and closing the storage space. The storage space may be divided into a plurality of spaces in an up and down direction or a left and right direction, and the plurality of spaces may be cooled at different temperatures and used as a refrigerating compartment or a compartment.

Further, the door 20 may open and close each of the plurality of storage spaces. Further, the door 20 may be mounted to be pivotable with respect to or extendable and retractable in a sliding manner from and into the cabinet 10, and may independently open and close each storage space. In the present embodiment, the storage space is divided in the up and down direction, and the door 20 also includes an upper door 21 and an inner door 22.

The cabinet 10 may include an outer case 101 forming an outer shape and an inner case for defining the storage space inside the outer case 101. Further, an insulator may be filled between the outer case 101 and the inner case to allow the storage space to be insulated.

A machine room 11 may be defined in a lower end of a rear face of the cabinet 10. The machine room 11 defines a space in which a plurality of electrical components including components constituting a refrigeration cycle for cooling the storage space are arranged, and the space may be independent by being divided from the storage space. In addition, the machine room 11 may be in communication with an external space, so that the components inside the machine room 11 may be cooled or heat exchanged.

In detail, a bottom face of the machine room 11 may be formed by a bottom plate 111. A compressor 30 for compressing a refrigerant at a high temperature and a high pressure and supplying the compressed refrigerant, a condenser 50 for dissipating heat of the refrigerant of the high temperature and the high pressure supplied from the compressor 30, and a blowing fan unit 60 for forcibly flowing air in the machine room 11 may be arranged on the bottom plate 111. The compressor 30, the condenser 50, and the blowing fan unit 60 may be mounted directly or indirectly on the bottom plate 111.

The interior of the machine room 11 may be divided into left and right sides with respect to the blowing fan unit 60. In FIG. 1, the condenser 50 may be disposed on the right side and the compressor 30 may be disposed on the left side. A region on the right side in which the condenser 50 is disposed may be referred to as a suction portion 11*a* through which outside air is sucked, and a region on the left side in which the compressor 30 is disposed may be referred to as a discharge portion 11*b* through which the outside air is discharged.

A machine room cover 12 may be mounted on a machine room opening 101*a* defined in a rear face of the machine room 11. The machine room cover 12 may form an outer shape of the rear face of the machine room 11 and of a portion of a rear face of the refrigerator 1. Further, the machine room opening 101*a* may be shielded to prevent the components inside the machine room 11 from being exposed to the outside.

A height H of the machine room opening 101*a* may correspond to a height of an upper end of the condenser 50. The bottom face of the machine room 11 is formed by the bottom plate 111, and a top face including a front face of the machine room 11 may be formed by a top plate 102. Further, the height H of the opening of the machine room 11 may be defined by a distance between a rear end of the bottom plate 111 and a rear end of the top plate 102, and may be equal to or substantially the same as the height of the condenser 50.

That is, when the machine room cover 12 is opened, the machine room opening 101*a* may be exposed to the outside. In this connection, the condenser 50 becomes able to be mounted and disassembled while entering and exiting the machine room opening 101*a* in a sliding manner in a front and rear direction. Further, the condenser 50 becomes separable and mountable through the machine room opening 101*a*. Accordingly, even when the height H of the machine room opening 101*a* is substantially the same as the height of the condenser 50, there is no interference during assembly and disassembly for service, so that the height and the space of the machine room 11 may be minimized.

A separation and mounting structure of the condenser 50 will be described in more detail below. In one example, a suction hole 121 through which the outside air is sucked and a discharge hole 122 through which air inside the machine room 11 is discharged to the outside may be defined in the machine room cover 12. The suction hole 121 may be defined at a position corresponding to the condenser 50, and the discharge hole 122 may be defined at a position corresponding to the compressor 30. The discharge hole 122 and the suction hole 121 may be defined in a shape of a grill constituted by a plurality of holes, and may be defined to be inclined or rounded such that the air sucked and discharged may have a directionality.

In addition, a cabinet suction hole (not shown) and a cabinet discharge hole 101*b* may be respectively defined in both side faces of the cabinet 10 respectively corresponding to both side faces of the machine room 11. The cabinet suction hole, which is a passage through which the outside air is sucked, may be defined to be in communication with the suction portion 11*a*, that is, the region in which the condenser 50 is disposed. The cabinet discharge hole 101*b*, which is a passage through which the air in the machine room 11 is discharged to the outside, may be defined to be in communication with the discharge portion 11*b*, that is, the region in which the compressor 30 is disposed.

Each side frame 113 for forming each side face of the machine room 11 may be disposed at each of both left and right side faces of the bottom plate 111. In addition, a frame suction hole 113*a* and a frame discharge hole 113*b* may be respectively defined in the side frames 113. In this connection, the frame suction hole 113*a* may be defined at a position corresponding to the cabinet suction hole (not shown) and in communication with the cabinet suction hole. Further, the frame discharge hole 113*b* may be defined at a position corresponding to the cabinet discharge hole 101*b* and in communication with the cabinet discharge hole 101*b*.

In addition, a plate suction hole 111*a* and a plate discharge hole 111*b* may be defined in the bottom plate 111 forming the bottom face of the machine room 11. The plate suction hole 111*a* may be defined in the region of the suction portion 11*a* and may be defined in a horizontally long shape at a front end of the bottom plate 111. In addition, the plate discharge hole 111*b* may be defined in the region of the discharge portion 11*b* and may be defined in a horizontally long shape at the front end of the bottom plate 111.

As shown in FIG. 3, as an overall structure of the machine room 11, the suction portion 11*a* and the discharge portion 11*b* are respectively disposed on the left and right sides of the machine room 11 by the blowing fan unit 60, and the suction and the discharge of the air may be performed in three dimensions. In detail, the outside air is forcibly sucked through the suction hole 121, the plate suction hole 111*a*, and the cabinet suction hole (not shown) respectively at the front, at the rear, and at the side with respect to the condenser 50, flowed into the suction portion 11*a*, and passes through a front face, rear face, and a side face of the condenser 50 along an inner perimeter of the suction portion 11*a*. That is, the outside air evenly passes all faces of the condenser 50, so that effective heat dissipation of the condenser 50 may be achieved.

Further, the air inside the machine room 11 may cool the compressor 30 through the discharge hole 122, the plate discharge hole 111*b*, and the cabinet discharge hole 101*b* respectively at the front, at the rear, and at the side with respect to the compressor 30, and then be discharged to the outside. That is, the air discharged by the blowing fan unit 60 may cool the compressor 30 while passing the compressor 30 at the side and then be discharged through front, rear, and side portions of the discharge portion 11*b*. As such, the heat of the condenser 50 is dissipated while the outside air is supplied in a three-dimensional manner to the suction portion 11*a* by the operation of the blowing fan unit 60, and the air may be discharged to the outside through the discharge portion 11*b* after cooling the compressor 30 in the three-dimensional manner.

In one example, a water valve 71 for supplying water to an ice maker or a dispenser disposed in the refrigerator 1 may be disposed in the machine room 11. In addition, an expansion device 74 (at least one of an expansion valve, an electronic expansion valve, or a capillary tube) for decompressing a refrigerant discharged from the condenser 50 for evaporation may be further disposed.

In addition, a base pan 40 on which the condenser 50 is mounted may be disposed on the bottom plate 111. In addition, drain hoses 72 and 73 for discharging defrosted water generated in an evaporator or a space in which the evaporator is disposed to the base pan 40 may be vertically arranged on the base pan 40. The drain hoses 72 and 73 may include a plurality of drain hoses based on the number of evaporators, and the plurality of drain hoses may be respectively extended from positions corresponding to positions of the evaporators to a top face of the base pan 40. The base pan 40 may be referred to as a drain pan because the defrosted water discharged by the drain hoses 72 and 73 is stored therein.

Figure 4:
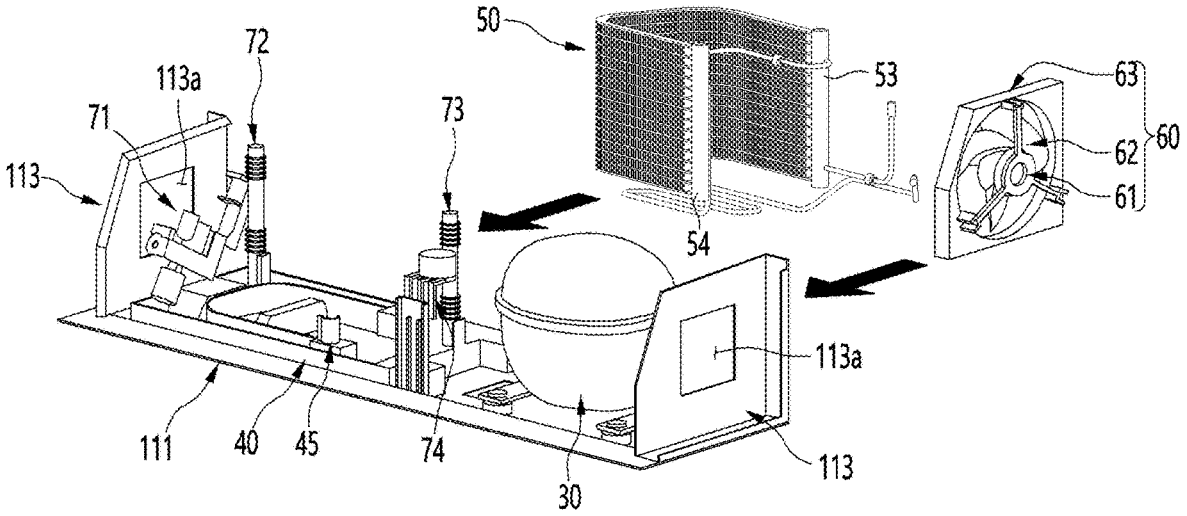
FIG. 4 is an exploded perspective view illustrating a state in which a condenser and a blowing fan in the machine room are separated from each other.

As shown in FIG. 4, the bottom plate 111 may be formed in a planar shape to form a bottom face of the machine room 11. In addition, each side frame 113 may be formed at each of both left and right ends of the bottom plate 111. Each side frame 113 forms each side face of the machine room 11 and may be combined with each of both side ends of the top plate 102. Further, each of the frame suction hole 113*a* and the frame discharge hole 113*b* may be defined in a center of each side frame 113.

Further, the base pan 40 may be mounted on the bottom plate 111. The base pan 40 may be located, among both left and right sides, in the region of the suction portion 11*a* in which the condenser 50 is mounted. Further, the condenser 50 and the blowing fan unit 60 may be mounted on the top face of the base pan 40.

The condenser 50 and the base pan 40 may be easily separated and mounted through the machine room opening 101*a* for a service even after the machine room 11 is assembled and mounted in the cabinet 10. In particular, the condenser 50 and the base pan 40 may enter and exit the machine room 11 while moving in a front and rear direction through the machine room opening 101*a*. Therefore, the machine room 11 does not require a separate extra space for separation and installation of the condenser 50 and the blowing fan 62 upwards. Therefore, the machine room 11 may have a minimum height and a minimum volume.

The blowing fan unit 60 may include a blowing fan 62, a fan motor 61 for rotating the blowing fan 62, and a fan guide 63 on which the blowing fan 62 and the fan motor 61 are arranged. A lower end of the fan guide 63 may be fixed to a blowing fan unit mounting portion 47 to be described below. Further, in a state in which the fan guide 63 is mounted, a perimeter of the fan guide 63 is in contact with the top plate 102. When the blowing fan 62 is rotated, the air in the suction portion 11*a* may be directed to the discharge portion 11*b* through the blowing fan 62.

In one example, the blowing fan unit 60 may be mounted on the base pan 40 in an assembled state. In this connection, the blowing fan unit 60 may be inserted into the machine room 11 in an inclined state to avoid interference with refrigerant pipes extending from the compressor 30 to the condenser 50. Further, the blowing fan unit 60 may be mounted on the blowing fan unit mounting portion 47 by horizontally moving the lower end of the fan guide 63 inside the machine room 11.

In particular, fixing parts (or fixing mounts) 45 and 46 for allowing the condenser 50 to be detached while sliding in the front and rear direction may be arranged on the base pan 40. Therefore, a structure in which the condenser 50 may be easily mounted and separated even in the machine room 11 having a low height is achieved.

Figure 5:
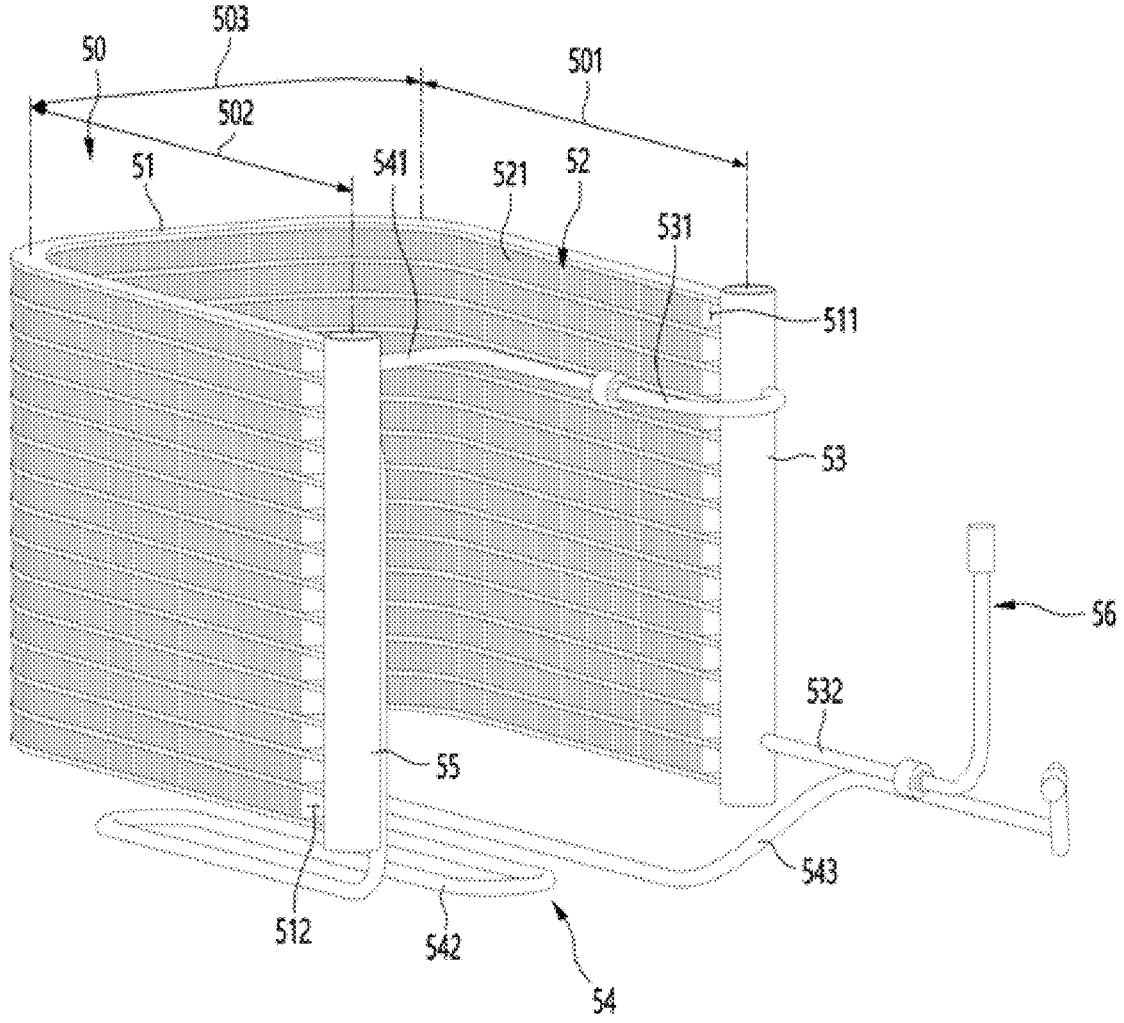
FIG. 5 is a perspective view of the condenser.

Hereinafter, structures of the condenser 50 and the base pan 40 will be described in more detail with reference to FIG. 5. As shown in the drawing, the condenser 50 may be formed in a shape of being bent along front, rear, and side faces of the suction portion 11*a*. The condenser 50 may include a first straight portion (or first condenser section) 501 extending horizontally with the machine room cover 12 at the rear face of the machine room 11, that is, a position facing the machine room cover 12, a second straight portion (or second condenser section) 502 disposed parallel to the first straight portion 501 at a position spaced apart from the first straight portion 501, and a bent portion (or third condenser section) 503 connecting ends of the first straight portion 501 and the second straight portion 502 with each other, and formed at a position facing the side face of the machine room 11.

Further, the condenser 50 extends from the base pan 40 to an upper end of the machine room 11 in the vertical direction. Therefore, all of the air sucked into the suction portion 11*a* in various directions may be directed to the blowing fan unit 60 by passing through the condenser 50.

In detail, the condenser 50 may include a pair of first header (or a first header post) 53 and second header (or a second header post) 55, a plurality of tubes 51 for connecting the first header 53 and the second header 55 with each other, and each heat exchange fin 52 for connecting two adjacent tubes 51 vertically arranged with each other. Such a configuration, which is usually referred to as a micro channel condenser structure, may have a relatively compact size and may have an excellent heat exchange performance.

In one example, the first header 53 and the second header 55 may be spaced apart from each other in the front and rear direction, and may be elongated in the vertical direction to have the same height. The first header 53 and the second header 55 may be respectively connected to both ends of the plurality of tube 51, and partition walls may be respectively formed inside the first header 53 and the second header 55 to determine a flow path of the refrigerant flowing along the plurality of connected tubes 51.

An input connector 531 for supplying the refrigerant toward the condenser 50 and an output connector 532 for discharging the refrigerant from the condenser 50 side may be vertically arranged on the first header 53. Further, an input pipe 54 connected to the compressor 30 may be connected to the input connector 531, and an output pipe 56 connected to the expansion device 74 may be connected to the output connector 532.

The refrigerant of a high temperature and a high pressure introduced through the input connector 531 may flow to the second header 55 by passing the plurality of tubes 51 through the first header 53. Further, the refrigerant flowed to the second header 55 may change a direction thereof by the second header 55, then pass the plurality of other tubes 51, and then flow to the first header 53. Finally, the refrigerant is directed to the expansion device 74 through the output connector 532 and the output pipe 56.

The tube 51 may be formed of a structure in which a plurality of channels or flow paths are continuously arranged in the horizontal direction, and both ends thereof may be formed to connect the first header 53 and the second header 55 with each other. Further, the plurality of tubes 51 may have the same structure and shape, and may be continuously arranged at regular spacings in the vertical direction along the first header 53 and the second header 55.

In addition, the heat exchange fins 52 may be arranged in a space between the plurality of the tubes 51. Each heat exchange fin 52 may be disposed along a space between two adjacent tubes of the plurality of tubes 51 while being continuously bent in a zigzag shape. Each fin opening 521 may be defined between a pair of vertically arranged tubes 51 and a bent portion of the heat exchange fin 52. In addition, a contact area of the air passing through the fin openings 521 defined by each heat exchange fin 52 may be increased, and an efficiency of heat exchange with the refrigerant inside the tube 51 may be increased.

The heat exchange fins 52 may be arranged at positions slightly spaced from the first header 53 and the second header 55. A first restraining hole 511 and a second restraining hole 512 may be respectively defined at both ends of each heat exchange fin 52 by the first header 53, the second header 55, and each heat exchange fin 52, and the pair of tubes 51 vertically arranged. The first restraining hole 511 and the second restraining hole 512 may be defined in sizes respectively corresponding to a first restraining protrusion 463 and a second restraining protrusion 453 to be described below.

In one example, the input pipe 54 connecting the condenser 50 and the compressor 30 with each other may be bent multiple times, and at least a portion of the input pipe 54 may be disposed in an internal space defined by bending the condenser 50. In detail, the input pipe 54 may include an input pipe extension 543 extending from the compressor 30 toward a bottom of the internal space, a lower bent portion 542 extending inward of a water collecting space 433*a* defined in the base pan 40 from an end of the input pipe extension 543, and an upper bent portion 541 connecting an end of the lower bent portion 542 and the first header 53 with each other.

The input pipe extension 543 may be connected to an outlet of the compressor 30, and may be extended to the bottom of the internal space. In addition, the lower bent portion 542 may be repeatedly bent multiple times inside the water collecting space 433*a* to increase a contact area with water stored in the water collecting space 433*a*. In addition, the water stored in the water collecting space 433*a* may be evaporated by the refrigerant of the high temperature passing through the lower bent portion 542. In addition, a pipe support 75 for supporting the lower bent portion 542 may be disposed in the water collecting space 433*a*. Therefore, the lower bent portion 542 may be remained at a set position, so that the water inside the water collecting space 433*a* may be effectively evaporated.

In addition, the upper bent portion 541 may be formed to extend upward from one end of the lower bent portion 542 and bent along an inner face of the condenser 50. Further, an end of the upper bent portion 541 may be connected to the input connector 531. In a process of extending toward the first header 53, the upper bent portion 541 is bent along the inner face of the condenser 50, so that the input pipe 54 may be prevented from shaking during the forced flow of the air by the operation of the blowing fan unit 60. In addition, the upper bent portion 541 is disposed along the inner face of the condenser 50, so that additional cooling may be achieved by the air passing through the condenser 50.

Figure 6:
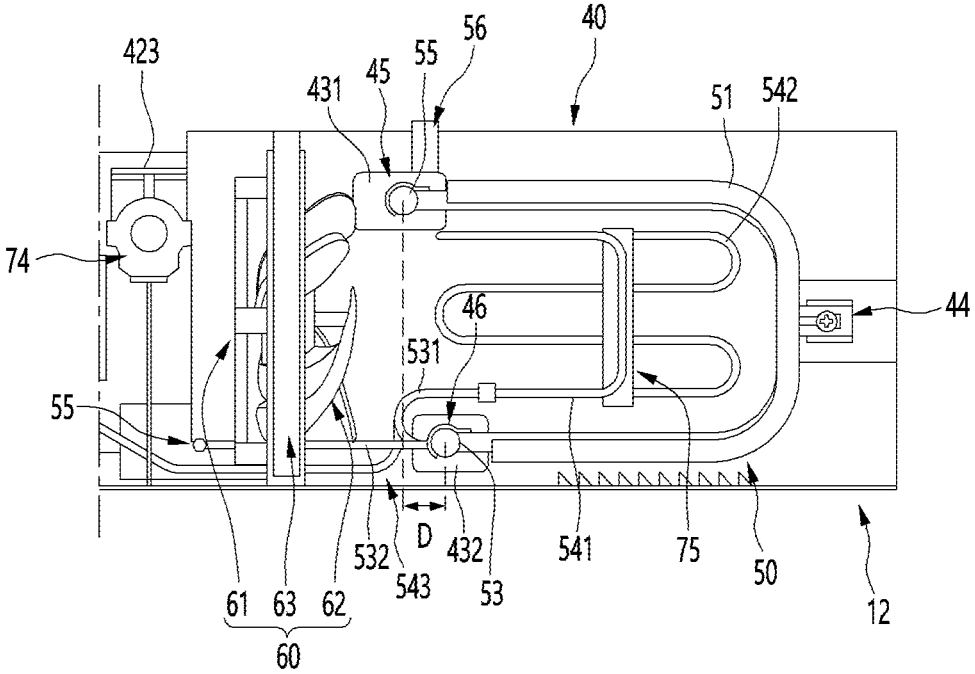
FIG. 6 is a plan view of the machine room in which the condenser is mounted.
Figure 7:
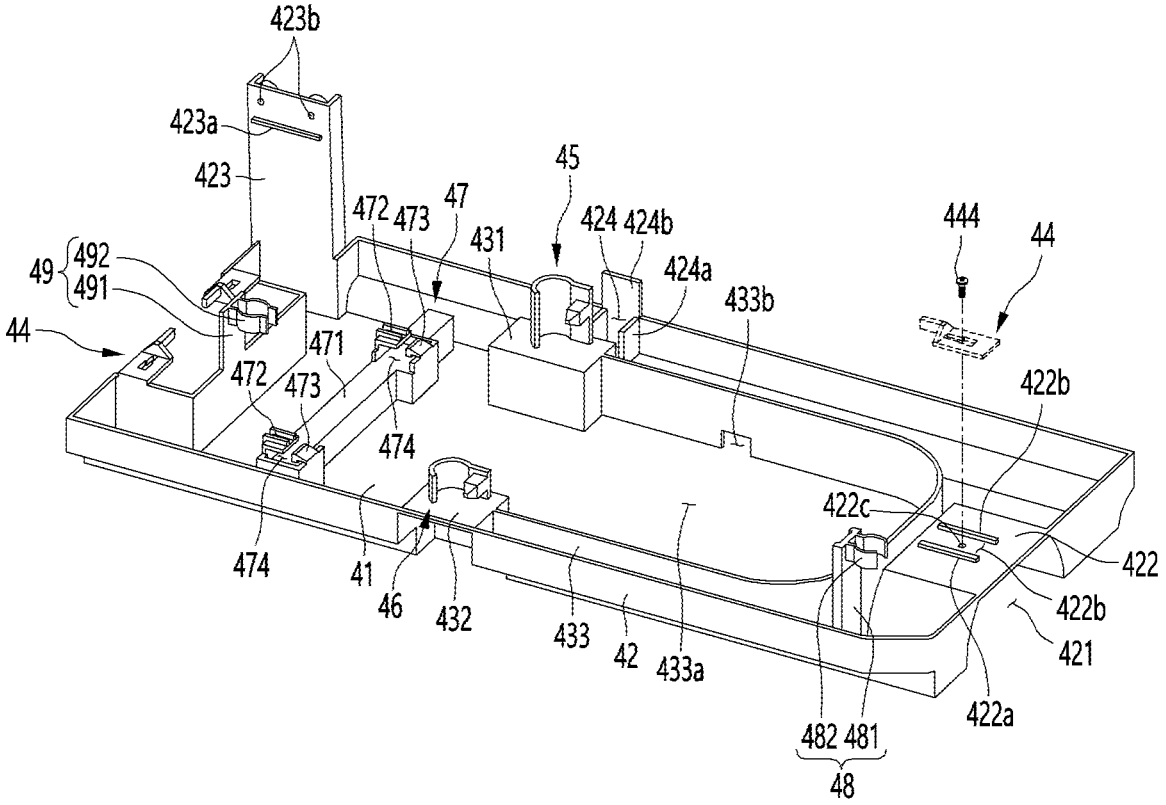
FIG. 7 is a perspective view of a base pan mounted in the machine room.
Figure 8:
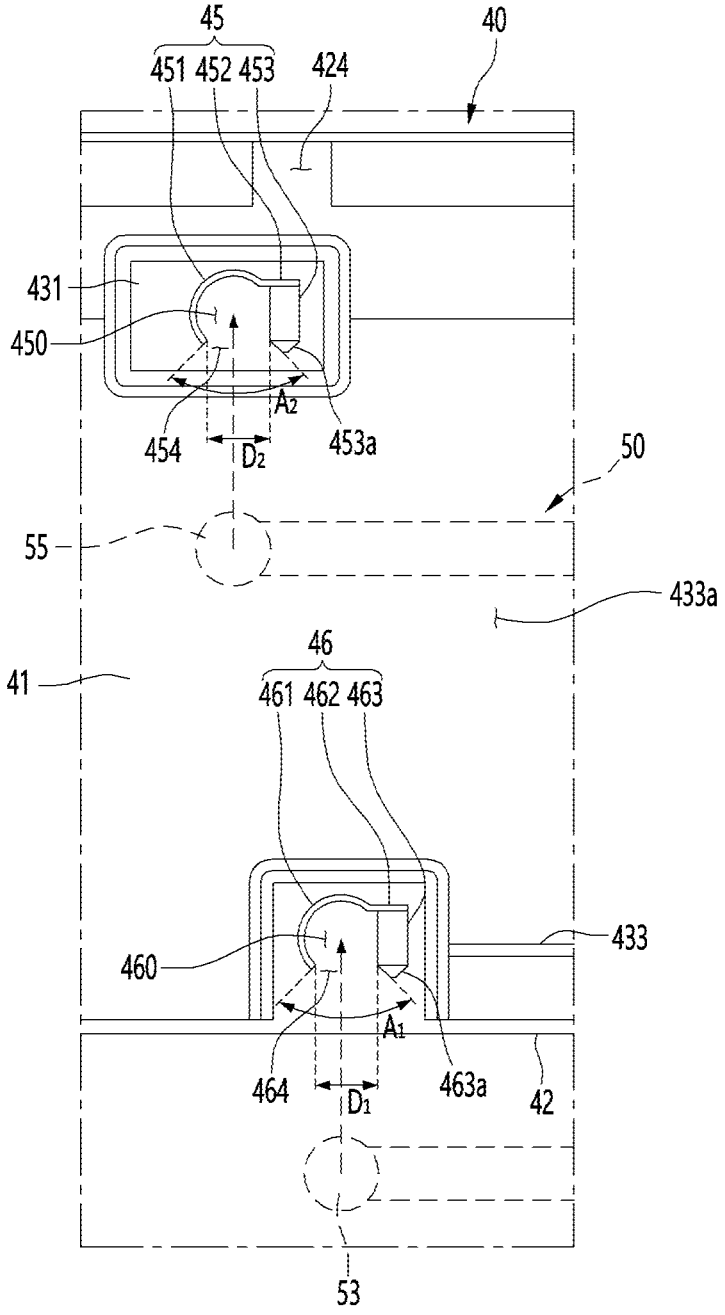
FIG. 8 is an enlarged view of fixing assemblies of the base pan viewed from above.

Hereinafter, a structure for mounting the condenser 50 will be described in more detail with reference to FIGS. 6-8. As shown, the base pan 40 may include a bottom face 41 formed in a plate shape and an edge 42 formed along a perimeter of the bottom face 41. The base pan 40 may be formed in an injection molding manner and made of a plastic material, and may be molded in a structure on which the condenser 50, the blowing fan unit 60, the drain hoses 72 and 73, the expansion device 74, and the like.

A first support 432 and a second support 431 protruding upwards may be respectively formed at positions respectively corresponding to positions where the first header 53 and second header 55 are arranged. The first support 432 and the second support 431 may have a height corresponding to a height of the edge 42, and top faces of the first support 432 and the second support 431 may have a planar shape.

In addition, a first fixing part 46 and a second fixing part 45 may be respectively formed on the top faces of the first support 432 and the second support 431. The first fixing part 46 and the second fixing part 45 respectively restrain lower ends of the first header 53 and the second header 55, so that the condenser 50 may be fixed and mounted to the base pan 40.

The first fixing part 46 and the second fixing part 45 may have the same structure, and may extend upwardly of the edge 42. Therefore, when moving the condenser 50 forward or rearward through the machine room opening 101*a*, the first header 53 and second header 55 may respectively fastened to the first fixing part 46 and the second fixing part 45 and may not interfere with the edge 42.

Structures of the first fixing part 46 and the second fixing part 45 are substantially the same, and the first fixing part 46 and the second fixing part 45 are different from each other only in a size and a position, so that a detailed description will be achieved based on the first fixing part 46.

The first fixing part 46 may include a first fixing portion 461 surrounding the first header 53, a first extension 462 extending from one side of the first fixing portion 461, and a first restraining protrusion 463 protruding from the first extension 462 to penetrate the condenser 50. Further, at least a portion of the first fixing portion 461 may be opened to define a first insertion hole 464 into which the first header 53 is inserted.

In detail, the first fixing portion 461 may be formed along a circumference of the lower end of the first header 53 and may have a predetermined height. Further, the first fixing portion 461 may shield at least 50% of the entire circumference of the lower end of the first header 53, and may be formed in a shape of being cut without shielding the first header 53 in a portion to define the forwardly opened first insertion hole 464.

The extended first extension 462 may be formed at one end of the first fixing portion 461 to support the condenser 50 inwardly. The first extension may have the same height as the first fixing portion 461, and is positioned forwardly of the first insertion hole 464. Further, the first extension 462 may be formed to extend horizontally with the inner face of the condenser 50 and at least pass through the first restraining hole 511.

The first restraining protrusion 463 protruding rearward may be formed on a rear face of the first extension 462. The first restraining protrusion 463 may be formed to have a length greater than a width of the tube 51, and may be formed in a corresponding shape to pass through the first restraining hole 511.

In addition, a first inclined portion 463*a* may be formed at an extended end of the first restraining protrusion 463. The first inclined portion 463*a* is formed such that a width of the first inclined portion 463*a* decreases rearwardly, so that the first inclined portion 463*a* may facilitate insertion of the first restraining protrusion 463 in the first fin opening 521 and guide the first header 53 to be easily inserted into the first insertion hole 464.

In one example, the first insertion hole 464 may be defined by the end of the first fixing portion 461 and the first restraining protrusion 463. The first insertion hole 464 may be defined between the end of the first fixing portion 461 and the first restraining protrusion 463, and may be defined to face the machine room opening 101*a*.

A width D1 of the first insertion hole 464 may be somewhat smaller than a diameter of the first header 53. In this connection, the first insertion hole 464 may be opened by a set angle A1 of approximately 100° to 110°, and the first fixing part 46 may accommodate approximately 70% of a total circumference of the first header 53. Therefore, the first header 53 may be press-fitted while moving forwardly from rearward of the first insertion hole 464.

In a state in which the first header 53 is press-fitted into the first fixing part 46, the first fixing portion 461 may support the circumference of the first header 53. The first fixing portion 461 may have a predetermined elasticity, and accordingly, may be elastically deformed when the first header 53 is inserted into the first insertion hole 464, so that the first header 53 may be more easily inserted. When the insertion is completed, an outer face of the first header 53 may be brought into close contact with an inner face of the first fixing portion 461, so that the first header 53 may be securely fixed.

Further, the first restraining protrusion 463 may be formed to have a cross-section corresponding to a size of the first restraining hole 511. Therefore, in a state in which the first restraining protrusion 463 is inserted into the first restraining hole 511, outer faces of the first restraining protrusion 463 may be brought into contact with the tubes 51 above and below the first restraining protrusion 463, each heat exchange fin 52, and the first header 53 to securely fix the compressor 30. That is, the first fixing part 46 may fix the first header 53 by the first fixing portion 461 and restrain the first straight portion 501 by the first restraining protrusion 463.

In one example, the second fixing part 45 has the same structure as the first fixing part 46, and may protrude from a top face of the second support 431. The second fixing part 45 may have a vertical dimension greater than that of the first fixing part 46. Therefore, the second fixing part 45 may restrain the second header 55 of the condenser 50 that moves forward by passing the first fixing part 46. That is, in the second fixing part 45, a second fixing portion (or second fixing wall) 451 and a second extension 452 may respectively have vertical dimensions respectively greater than the vertical dimensions of the first fixing portion (or first fixing wall) 461 and the first extension 462.

The second fixing part 45 defines a second insertion hole 454 by the second fixing portion 451, the second extension 452, and the second restraining protrusion 453. Further, a second inclined portion 453*a* is formed at a front end of the second restraining protrusion 453, so that the second restraining protrusion 453 may be easily inserted into the second restraining hole 512.

A width D2 of the second insertion hole 454 may be smaller than a diameter of the second header 55. Further, the second insertion hole 454 may also be opened by a set angle A2 of approximately 100° to 110°. Therefore, when the diameters of the first header 53 and the second header are the same, sizes of the first insertion hole 464 and the second insertion hole 454 may also be the same.

The first insertion hole 464 and the second insertion hole 454 may be rearwardly opened in the same manner. That is, both the first insertion hole 464 and the second insertion hole 454 may be opened toward the machine room opening 101*a*. Further, the first insertion hole 464 may be located at a position farther away from the blowing fan unit 60 by a set distance D than the second insertion hole 454. In this connection, the set distance D may be approximately 20 mm to 30 mm. In addition, the first header 53 and second header 55 of the condenser 50 may also be spaced apart from each other by the set distance D in the horizontal direction. Therefore, the first header 53 and second header 55 may not interfere with each other when the condenser 50 is mounted. Further, it is possible to identify that the first header 53 and the second header 55 are respectively coupled to the first fixing part 46 and the second fixing part 45 at correct positions. That is, an operator becomes able to work while identifying installation and separation processes of the condenser 50, as well as to easily identify a fixed state of the condenser 50.

In addition, the second fixing part 45 may fix the second header 55 by the second fixing portion 451 and restrain the second straight portion 502 by the second restraining protrusion 453. In one example, the fixing part for fixing the head of the condenser 50 is able to include only one of the first fixing part 46 and the second fixing part 45.

A sealing member mounting portion 424 may be defined between the second support 431 and the edge 42. The sealing member mounting portion 424 may include a first rib 424*a* extending from the bottom face 41, and a second rib 424*b* extending from the edge 42, and the sealing member mounting portion 424 may be defined in a space between the first rib 424*a*, the second rib 424*b*, and the second support 431.

A side sealing member (not shown) extending in the vertical direction may be inserted into the sealing member mounting portion 424. The side sealing member seals a space between the top plate 102 and the second header 55, so that inflowing air from the outside is prevented from bypassing without passing the condenser 50.

A barrier 433 for defining the water collecting space 433*a* may be disposed on the bottom face 41 of the base pan 40. Both ends of the barrier 433 may be respectively connected to the first support 432 and the second support 431, and may be laterally extended. In this connection, the barrier 433 may extend along a lower end of the condenser 50. Therefore, a space in which the defrosted water may be induced is defined between the first support 432 and the second support 431.

In a state in which the first header 53 and the second header 55 of the condenser 50 are respectively mounted to the first fixing part 46 and second fixing part 45, the lower end of the condenser 50 may be in close contact with the barrier 433. In one example, a seal (not shown) may be disposed between the lower end of the condenser 50 and an upper end of the barrier 433 as needed. Therefore, all of the outside air flowing through the faces of the suction portion 11*a* may pass through the condenser 50 without leaking.

In one example, a barrier opening 433*b* may be defined in one side of the barrier 433. The barrier opening 433*b* is defined between a lower end of the barrier 433 and the bottom face 41 such that water outside the water collecting space 433*a* may flow into the water collecting space 433*a*.

A blowing fan unit mounting portion (or fan mount) 47 may be formed at one end of the base pan 40, which is at the compressor 30 side. The blowing fan unit mounting portion 47 protrudes upward from the bottom face 41, and a first fastening portion (or first fastener) 472 and a second fastening portion (or second fastener) 473 may be arranged on a protruding top face of the blowing fan unit mounting portion 47.

The first fastening portion 472 and the second fastening portion 473 respectively protrude in directions facing each other. Further, the first fastening portion 472 and the second fastening portion are spaced from each other to define a space 474 therebetween for accommodating a lower end of the blowing fan unit 60. Further, a blowing fan unit coupling portion formed to be fastened in the space 474 between the first fastening portion 472 and the second fastening portion 473 may be formed at the lower end of the blowing fan unit 60. In this connection, the first fastening portion 472 at a position close to the compressor 30 side may be extended upwardly of the second fastening portion 473. Therefore, the blowing fan unit 60 may be fixedly mounted by the first fastening portion 472 and the second fastening portion 473 in a horizontally moving manner from a condenser 50 side to the compressor 30 side. In addition, the first fastening portion 472 and the second fastening portion 473 may respectively include a plurality of first fastening portions and a plurality of second fastening portions along the blowing fan unit mounting portion 47.

A wheel receiving portion 421 in which a moving wheel (not shown) for supporting the cabinet 10 is located is recessed at a position corresponding to one side of the cabinet 10 among both sides of the base pan 40. In addition, a third fixing part 422 for fixing the bent portion 503 of the condenser 50 may be formed above the wheel receiving portion 421.

A fixing member (or tab) 44 to be described below may be mounted on a top face of the third fixing part 422. The third fixing part 422 may include a fastening hole 422*c* defined therein through which a screw 444 penetrating the fixing member 44 is fastened. In addition, each restraining rib 422*a* that restrains each of both ends of the fixing member 44 may be formed at each of both sides of the fastening hole 422*c*. Further, a space 422*b* into which the fixing member 44 may be inserted may be defined between the pair of restraining ribs 422*a*. Therefore, the fixing member 44 may remain in a state of being fixedly mounted on the third fixing part 422.

Further, a first drain hose fixing part 48 may be formed between the barrier 433 and the wheel receiving portion 421. The first drain hose fixing part 48 may include a first post 481 extending upward from the bottom face 41, and a first mounting portion 482 into which the first drain hose 72 is press-fitted at an end of the first post 481. The first mounting portion 482 may be formed of a pair of rib structures that may press and fix an outer face of the first drain hose 72.

A second drain hose fixing part 49 for fixing the second drain hose 73 may be formed at one side end at the compressor 30 side among the both sides of the base pan 40. The second drain hose fixing part 49 may have the same shape and structure as the first drain hose fixing part 48, and may include a second post 491 and a second mounting portion 492.

In addition, an expansion device mounting portion 423 extending upward may be formed at an edge of the base pan 40 close to the compressor 30 side. The expansion device mounting portion 423 may be extended to have a predetermined height, and a screw hole 423*b* into which a screw penetrating the expansion device 74 is fastened may be defined in an upper end of the expansion device mounting portion 423. Further, a guide rib 423*a* for guiding such that the expansion device 74 is fixed in place may be protruded below the screw hole 423*b*.

The fixing member 44 may be formed at one end of the base pan 40 at the compressor 30 side. The fixing member 44 may be integrally formed when molding the base pan 40, and a recessed incision line may be formed at one end of the fixing member 44. Therefore, as shown in FIG. 7, a user may cut and separate the fixing member 44 molded on the base pan 40 along the incision line and then mount the cut and separated fixing member 44 on the third fixing part 422.

Figure 9:
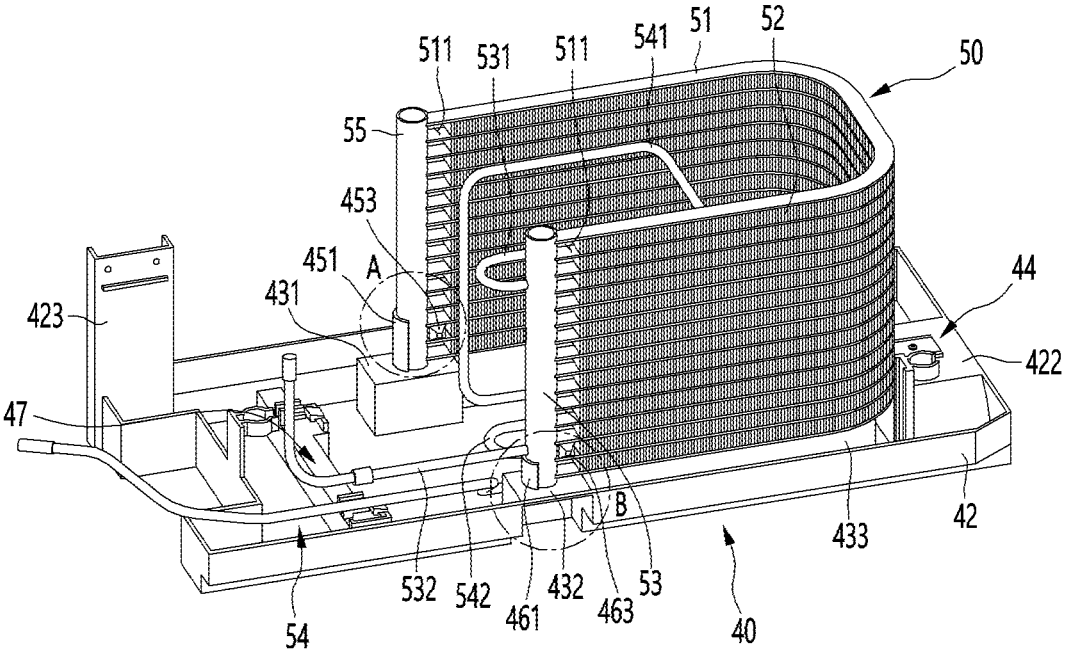
FIG. 9 is a view illustrating a state in which the condenser is mounted on the base pan.
Figure 10:
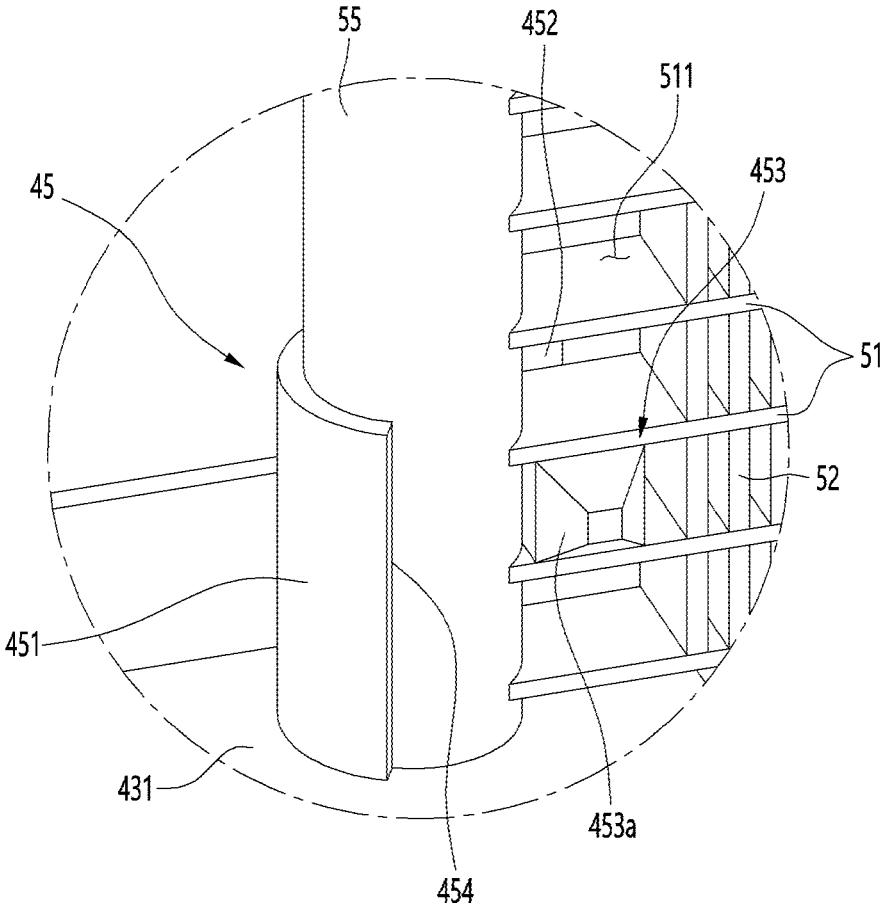
FIG. 10 is an enlarged view of a portion A of FIG. 9.
Figure 11:
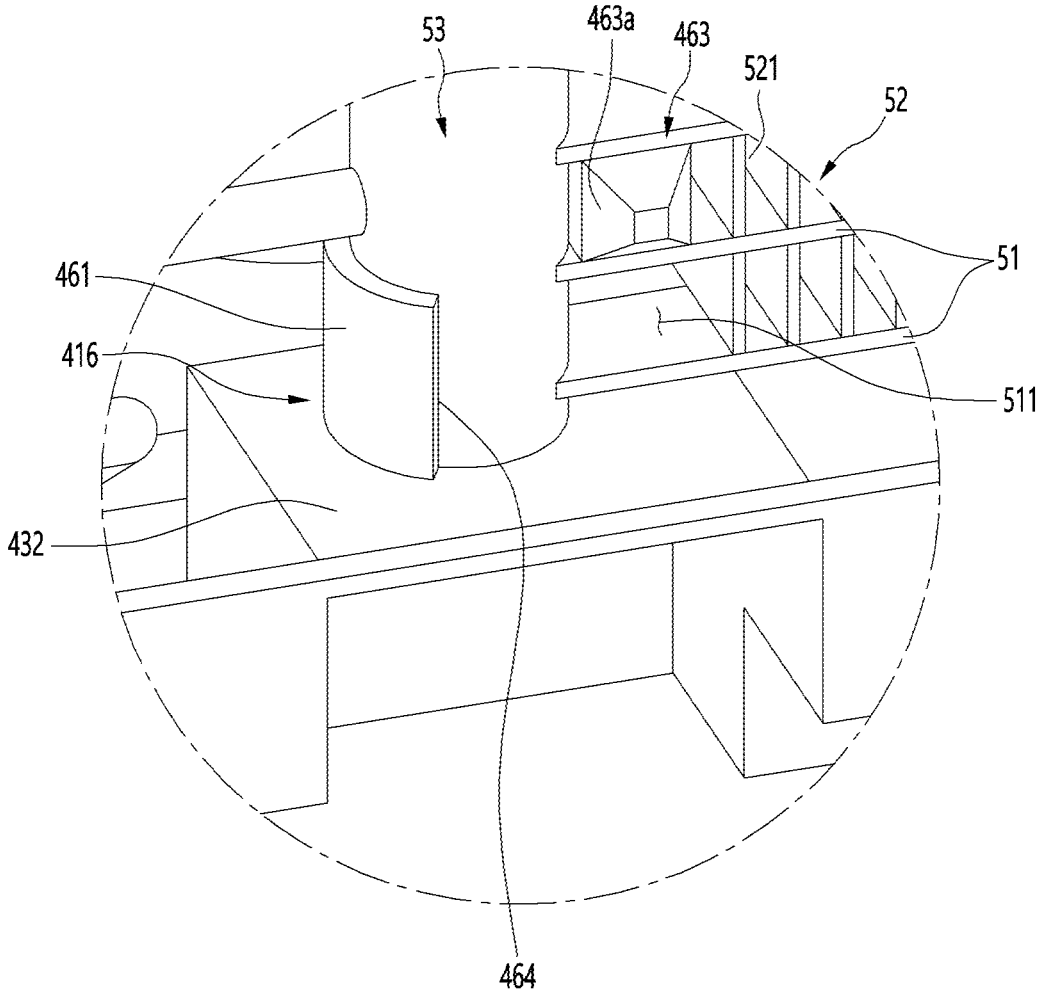
FIG. 11 is an enlarged view of a portion B of FIG. 9.

Hereinafter, the state in which the condenser 50 is mounted will be described in more detail with reference to FIGS. 9-11. As shown in the drawings, in the state in which the condenser 50 is mounted on the base pan 40, the first header 53 is inserted into the first insertion hole 464, and the first restraining protrusion 463 penetrates the first restraining hole 511. Therefore, a lower end of the first straight portion 501 may be completely restrained by the first fixing part 46.

Further, the second header 55 is inserted into the second insertion hole 454 and the second restraining protrusion 453 penetrates the second restraining hole 512. Accordingly, a lower end of the second straight portion 502 may be completely restrained by the second fixing part 45.

In one example, both the first insertion hole 464 and the second insertion hole 454 may be defined to be opened toward the machine room opening 101*a*. Therefore, the condenser 50 may be simply mounted on the base pan 40 through an operation of being inserted rearwardly toward the machine room opening 101*a* or inserted forwardly, without moving in the vertical direction.

In particular, the condenser 50 has a structure that does not require any movement in the vertical direction for the mounting and the separation. Therefore, the height of the machine room opening 101*a* becomes substantially the same as the height of the upper end of the condenser 50. Thus, even in the machine room 11 of a very compact structure, the condenser 50 may be mounted and separated without difficulty by the movement in the front and rear direction of the condenser 50.

In addition, one side face corresponding to the bent portion 503 of the condenser 50 may be fixed by the fixing member 44. The fixing member 44 may be mounted on the third fixing part 422 while the first header 53 and second header 55 are fixed. The condenser 50 may be fixed at three points by the mounting of the fixing member 44, and a solid mounting state may be maintained.

Figure 12:
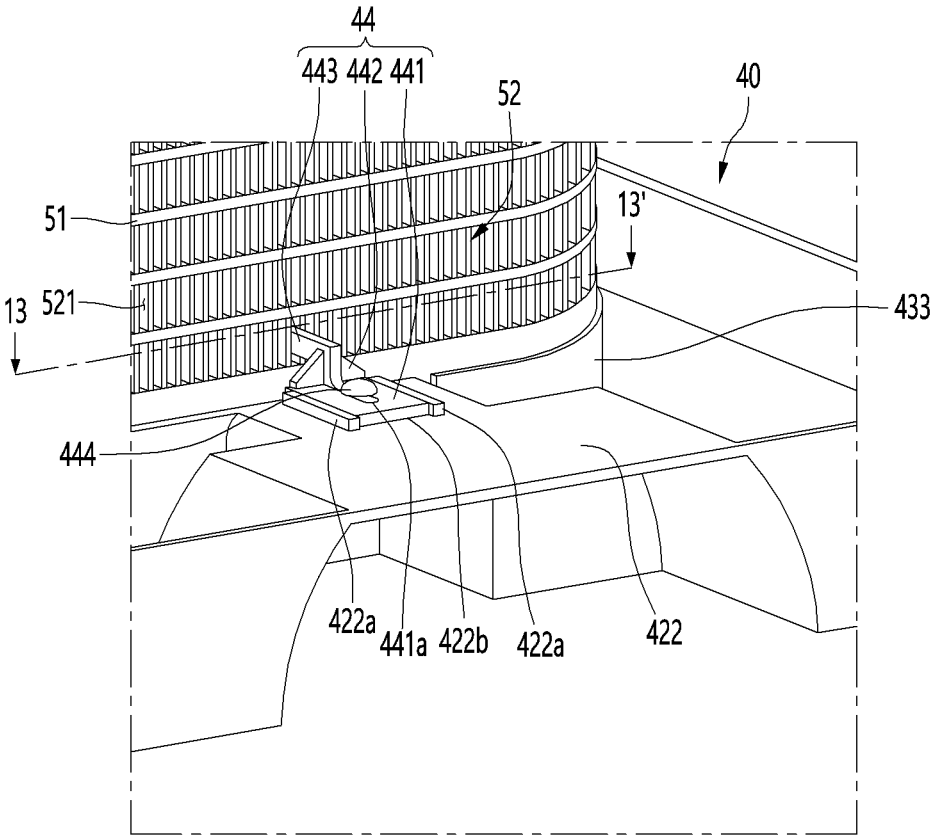
FIG. 12 is a view illustrating a fixed state of a bent portion of the condenser.
Figure 13:
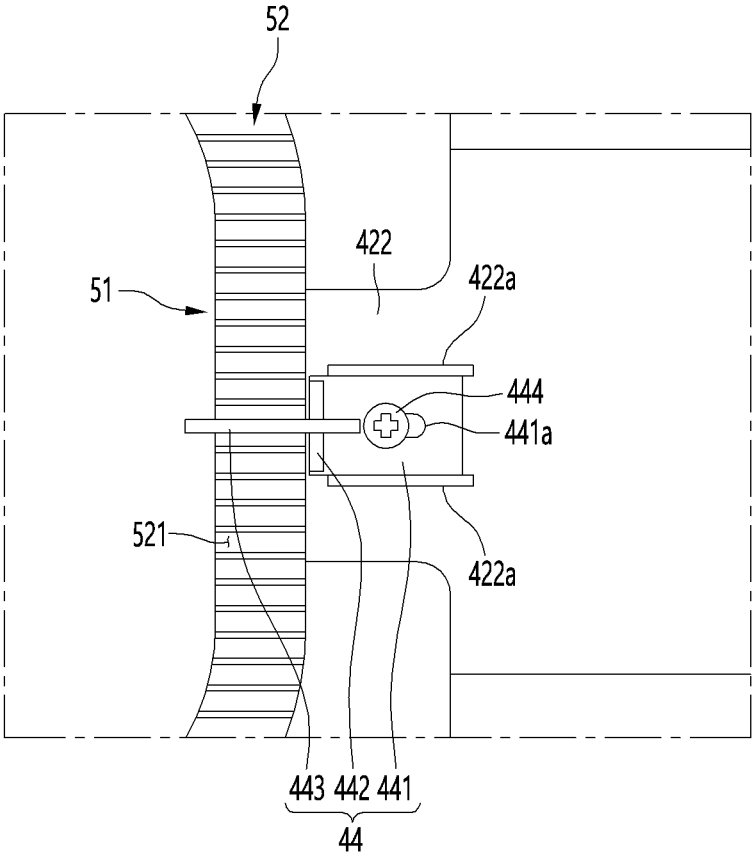
FIG. 13 is a cross-sectional view taken along a line 13-13' in FIG. 12.

Hereinafter, a structure of the fixing member and a fixing state of the bent portion will be described in more detail with reference to FIGS. 12-13. As shown in the drawings, the fixing member 44 may be molded integrally with the base pan 40, and then mounted on the third fixing part 422 in a state in which the condenser 50 is seated on the base pan 40.

The fixing member 44 may include a base fixing portion (or plate) 441 mounted on the third fixing part 422, and a restraining portion (or wall) 443 extending from the base fixing portion 441 to restrain the condenser 50. The base fixing portion 441 may be formed in a plate shape, and may be formed to be inserted between the restraining ribs 422*a* of the third fixing part 422. Further, a fixing member hole 441*a* may be defined in the base fixing portion 441. The fixing member hole 441*a* may be defined on an extension line in a direction equal to an extending direction of the restraining portion 443, and defined in a shape of a long hole to adjust the position of the fixing member 44. Further, the screw 444 may be fastened in the fixing member hole 441*a*, and the screw 444 may be fastened in the fastening hole 422*c* of the third fixing part 422, so that the fixing member 44 is fixedly mounted.

The restraining portion 443 may extend from one side end of the base fixing portion 441 toward the condenser 50, and may extend from the base fixing portion 441 to have a predetermined height. The restraining portion 443 may be formed to have a thickness capable of penetrating the fin opening 521, and pass through the fin opening 521 from outward of each heat exchange fin 52 to protrude to inward of each heat exchange fin 52.

A supporting rib 442 may be formed at both side faces of the restraining portion 443 and a front end of the base fixing portion 441. The supporting rib 442 may support the restraining portion 443 protruding from the base fixing portion 441 to reinforce a strength of the restraining portion 443. Therefore, without a separate change of a structure of the condenser 50, the restraint of the bent portion 503 of the condenser 50 may be completed by inserting the fixing member 44 into the fin opening 521 defined in each heat exchange fin 52 of the condenser 50, and then fixing the fixing member 44 on the third fixing part 422.

In particular, the fixing member 44 may have a structure of penetrating the bent portion 503 of the condenser 50 and being mounted in the bent portion 503 of the condenser 50 to restrain the movement of the condenser 50 in the front and rear direction. Therefore, unintended separation of the condenser 50, which may occur due to the mounting and separation structure of the condenser 50 by the movement in the front and rear direction of the condenser 50, may be fundamentally prevented. In addition, in the condenser 50, the first straight portion 501, the second straight portion 502, and the bent portion 503 may be respectively fixed to the first fixing part 46, the second fixing part 45, and the third fixing part 422 and remained in a stable mounting state.

An aspect of an embodiment of the present disclosure provides a refrigerator capable of increasing an interior volume of the refrigerator by minimizing a space in a machine room. Another aspect of an embodiment of the present disclosure is to provide a refrigerator in which assembly and a service of a condenser are easy. Another aspect of an embodiment of the present disclosure is to provide a refrigerator capable of satisfying a maintenance performance in a minimized machine room space.

In a first aspect of the present disclosure, there is provided a refrigerator comprising: a machine room rearwardly opened; a base pan disposed at a bottom of the machine room; and each fixing part protruding from the base pan and restraining a lower end of each header of a condenser, wherein each insertion hole opened toward the machine room opening is defined in each fixing part, so that the condenser is able to be mounted on or separated from the base pan while moving in a front and rear direction horizontally with the base pan.

In a second aspect of the present disclosure, there is provided a refrigerator including: a cabinet for defining a storage space therein; a machine room for defining a space separated from the storage space inside the cabinet and having a compressor disposed therein; a machine room cover for shielding a machine room opening defined in one face of the machine room; a base pan disposed in the machine room; a condenser including: a pair of headers mounted on the base pan and extending in a direction crossing the base pan; a plurality of tubes for connecting the pair of headers with each other; and each heat exchange fin disposed between two adjacent tubes spaced apart from each other; and each fixing part protruding upward from the base pan and fixing the condenser by restraining a lower end of each header, wherein each insertion hole opened toward the machine room opening is defined in each fixing part, wherein the condenser is able to move to pass through the machine room opening, and wherein the lower end of each header is inserted and mounted into each insertion hole and is separated by exiting each insertion hole by the movement of the condenser.

In one implementation of the second aspect, the base pan may include a bottom face, and an edge extending upwardly along a perimeter of the bottom face, and wherein the fixing part may protrude upwardly of the edge. In one implementation of the second aspect, each fixing part may include each fixing portion extending upwardly along a circumference of the lower end of each header, and wherein a portion of each fixing portion facing the machine room opening may be cut to define each insertion hole.

In one implementation of the second aspect, a width of the insertion hole may be smaller than a width of the header. In one implementation of the second aspect, each fixing part may further include: each extension extending from one end of each fixing portion along the tube to support the condenser inwardly; and each restraining protrusion protruding from each extension toward the machine room opening to penetrate the condenser.

In one implementation of the second aspect, each insertion hole may be defined as a space between the one end of each fixing portion and each restraining protrusion. In one implementation of the second aspect, each restraining hole opened to insert each restraining protrusion therein may be defined between each header and each heat exchange fin.

In one implementation of the second aspect, each restraining hole may be defined to be in contact with all of each header, a pair of vertically arranged tubes, and each heat exchange fin. In one implementation of the second aspect, a width of the restraining protrusion may decrease in a protruding direction.

In one implementation of the second aspect, the condenser may include: a pair of straight portions extending in a state of being separated from each other, wherein each header is disposed at one end of each straight portion; and a bent portion connecting the other ends of the pair of straight portions with each other. In one implementation of the second aspect, the base pan may further include a fixing member disposed outward of the bent portion and inserted into the bent portion to restrain the condenser.

In one implementation of the second aspect, the fixing member may be integrally molded with the base pan when the base pan is molded, and mounted on one side of the base pan corresponding to the bent portion after being separated from the base pan. In one implementation of the second aspect, the fixing member may include: a base fixing portion fixedly mounted on the base pan; and a restraining portion extending from the base fixing portion to pass through the bent portion.

In one implementation of the second aspect, a supporting rib for connecting both side faces of the restraining portion with a front end of the base fixing portion and supporting the restraining portion may be disposed. In one implementation of the second aspect, the restraining portion may be inserted to pass through a fin opening defined between a pair of vertically arranged tubes and each heat exchange fin. In one implementation of the second aspect, a pair of restraining ribs respectively supporting both ends of the base fixing portion may be protruded from the base pan.

In one implementation of the second aspect, a blowing fan unit mounting portion for mounting a blowing fan unit for forcing an air flow inside the machine room thereon may be formed on the base pan, wherein the blowing fan unit mounting portion may include a first fastening portion and a second fastening portion respectively protruding at positions separated from each other in a direction facing each other, and defining therebetween a space for mounting the blowing fan unit therein, and wherein the first fastening portion may protrude upwardly of the second fastening portion, so that the blowing fan unit may be mounted while horizontally moving to pass the second fastening portion.

In a third aspect of the present disclosure, there is provided a refrigerator including: a cabinet for defining a storage space therein; a machine room for defining a space separated from the storage space inside the cabinet and having a compressor disposed therein; a machine room cover for shielding a machine room opening defined in one face of the machine room; a base pan disposed in the machine room; a condenser including: a first header and a second header formed in a shape of being bent along a front face, a rear face, and one side face of the machine room, and extending in a direction intersecting with the base pan; a plurality of tubes vertically spaced apart from each other to connect the first header with the second header; and each heat exchange fin disposed between two adjacent tubes vertically spaced apart from each other; a first fixing part protruding from the base pan and restraining a lower end of the first header; and a second fixing part protruding from the base pan and restraining a lower end of the second header, wherein a first insertion hole and a second insertion hole opened toward the machine room opening are respectively defined in the first fixing part and the second fixing part, wherein the condenser is able to move to pass through the machine room opening, and wherein the first header and the second heater are respectively inserted and mounted into the first insertion hole and the second insertion hole and are separated by respectively exiting the first insertion hole and the second insertion hole by the movement of the condenser.

In one implementation of the third aspect, the first fixing part and the second fixing part may protrude upwards, and may be spaced apart from each other by a set distance in a horizontal direction. In one implementation of the third aspect, the first fixing part may be disposed frontward of the second fixing part and have a vertical dimension smaller than a vertical dimension of the second fixing part.

In another implementation, a refrigerator comprises: a cabinet defining a storage space therein; a machine room provided in the cabinet and separated from the storage space; a compressor provided in the machine room; a machine room cover configured to be detachably coupled to the cabinet, the machine room cover shielding a machine room opening when attached to the cabinet; a base pan configured to be received in the machine room; a condenser that is configured to be received in or removed from the machine room through the machine room opening and includes: header posts configured to be mounted on the base pan and to extend in a direction intersecting the base pan when coupled to the base pan; a plurality of tubes that are spaced apart from each other and extend between the header posts; and a plurality of fins, each of the fins being provided between an adjacent pair of the tubes; and mounts that protrude upward from the base pan, wherein the mounts define insertion holes that are opened toward the machine room opening, and wherein lower ends of the header posts are configured to be received in the insertion holes to couple the condenser to the base pan, and to be separated from the insertion holes to uncouple the condenser from the base pan.

The base pan includes: a bottom face; and an edge extending upwardly along a perimeter of the bottom face, wherein the mounts protrude vertically at the edge. Each of the mounts includes a fixing wall extending vertically to correspond to a circumference surface of the lower end of a corresponding one of the header posts, and the fixing walls are positioned and curved to define the insertion holes that face the machine room opening.

A width of the insertion holes defined by the fixing walls may be less than a width of the header posts. Each of the mounts may further include: an extension extending from one end of a corresponding one of the fixing walls along at least one of the tubes to support the condenser inwardly; and a restraining protrusion protruding from a corresponding one of the extensions and toward the machine room opening to penetrate the condenser.

Each of the insertion holes may be defined between the one end of the corresponding one of the fixing walls and the corresponding one of the restraining protrusions. Restraining holes that are configured to receive the restraining protrusions therein may be defined between the header posts and at least one of the heat exchange fins.

Each of the restraining holes may be defined within a region defined by a corresponding one of the headers, a vertically separated pair of the tubes, and one of the heat exchange fins. A width of the restraining protrusion may decrease in a protruding direction toward the machine room opening.

The condenser may be u-shaped and may include: first and second condenser sections that are positioned to be separated from each other, wherein the header posts are positioned, respectively, at first ends of the first and second condenser sections; and a third condenser section that extends between second ends of the first and second condenser sections. The base pan may further include a fixing tab that is configured to inserted into the third condenser section portion to restrain the condenser.

The fixing tab may be molded with the base pan, and may be configured to be separated from the base pan and mounted on one side of the base pan corresponding to the third condenser section. The fixing tab may include: a base plate configured to be fixedly mounted on the base pan; and a restraining wall extending from the base plate to pass into a portion of the third condenser section.

The fixing tab may include a supporting rib that connects side faces of the restraining wall with an end of the base plate. A portion of the restraining wall may be inserted through a fin opening defined between a vertically separated pair of the tubes and a pair of the heat exchange fins extending between the pair of the tubes. The refrigerator may comprise restraining ribs that are protruded from the base pan and configured to support respective ends of the base plate.

A fan mount configured to receive a blowing fan to generate an air flow inside the machine room may be formed on the base pan, the fan mount may include a first fastener and a second fastener protruding at respective positions that are separated to define a space in which the blowing fan is received, and the first fastener may protrude vertically higher than the second fastener, so that the blowing fan configured to be received in the fan mount while horizontally moving to pass the second fastener.

In another implementation, a home appliance comprises: a cabinet for defining a machine room; a compressor provided in the machine room; a machine room cover that is configured to be removably coupled to the cabinet and is configured to shield a machine room opening when coupled to the cabinet; a base pan configured to be received in the machine room; a condenser configured to installed in or removed from the machine room through the machine room opening, the condenser having a first section, a second section separated from the first section and positioned further from the machine room opening than the first section, and a third section connecting first ends of the first section and the second section, the condenser including: a first header post and a second header post provided at second ends of the first and second sections and extending in a direction intersecting the base pan; a plurality of tubes that are vertically spaced apart and extend between the first header post and the second header post; and heat exchange fins provided between adjacent pairs of the tubes; a first mount protruding from the base pan and configured to receive a lower end of the first header post; and a second mount protruding from the base pan and configured to receive a lower end of the second header post, wherein a first insertion hole and a second insertion hole opened toward the machine room opening are defined, respectively, in the first mount and the second mount, and wherein the first header and the second heater configured to be inserted and mounted in the first insertion hole and the second insertion hole when the condenser is moved into the machine room through the machine room opening, and are configured to move out of and be released from the first insertion hole and the second insertion hole when the condenser is moved through the machine room opening to be removed from the machine room.

In this home appliance, the first mount and the second mount protrude upwards, and are spaced apart from each other by a set distance in a horizontal direction. The first mount may be positioned closer to the machine room opening than the second mount, and the first mount extends a vertically shorter height from the base pan than the second mount.

In the refrigerator according to an embodiment of the present disclosure, following aspects may be provided. The fixing parts protrude from the base pan that is disposed in the machine room and fixing and mounting the condenser thereon. In this connection, each fixing part protrudes more than the edge of the base pan and has each insertion hole defined therein toward the machine room opening, so that the condenser moves horizontally with the base pan. The condenser may be mounted and detached as each header of the condenser enters and exits each insertion hole.

That is, a structure in which the condenser is detachable by the movement in the front and rear direction without the movement in the up and down direction when separating or mounting the condenser for the service may be provided. Therefore, the condenser does not need to move in the up and down direction in the machine room, so that a height of an upper end of the machine room is able to be reduced to be substantially equal to a height of a upper end of the condenser.

As a height of the machine room is reduced, a total volume of the machine room may be reduced, and thus, a volume of the storage space in the refrigerator may be increased. Moreover, the condenser may be easily detached without any difficulty even in the machine room space having such a minimum volume, a maintenance performance may be satisfied. Further, as the condenser is able to be detached at one time by being horizontally moved without mounting the condenser in a complicated structure, or without a complicated manipulation such as pushing, ascending, descending, and the like for mounting or separating the condenser, the assembly and the service are facilitated.

In addition, the pair of fixing parts are spaced apart from each other in a left and right direction, and thus, the fixing parts may be exposed without being interfered with or blocked when the condenser is mounted. Therefore, an operator becomes able to work while easily identifying a coupling state of each fixing part and each header, thereby facilitating the assembly service.

In addition, the fixing parts further include the restraining protrusions, respectively, so that not only the headers but also a pair of straight portions constituting the condenser are able to be restrained, thereby providing a more stable fixation structure. In addition, the fixing member for restraining the bent portion of the condenser is further provided, so that the condenser may be restrained in the front and rear direction by the fixing member. Therefore, each header may be prevented from being unintentionally separated through each insertion hole. In addition, the fixing member is formed to penetrate each of a plurality of fin openings defined between the vertically arranged tubes and the heat exchange fins, so that even when a separate coupling structure is not added, the condenser may be maintained in the stable mounting state using only the fixing member.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet defining a storage space therein;

a machine room provided in the cabinet and separated from the storage space;

a compressor provided in the machine room;

a machine room cover configured to be detachably coupled to the cabinet, the machine room cover shielding a machine room opening when attached to the cabinet;

a base pan configured to be received in the machine room;

a condenser that is configured to be received in or removed from the machine room through the machine room opening and includes:

header posts configured to be mounted on the base pan and to extend in a direction intersecting the base pan when coupled to the base pan;

a plurality of tubes that are spaced apart from each other and extend between the header posts; and a plurality of fins, each of the fins being provided between an adjacent pair of the tubes; and mounts that protrude upward from the base pan, wherein each of the mounts includes:

a fixing wall extending vertically to correspond to a circumference surface of the lower end of a corresponding one of the header posts;

an extension extending from one end of the fixing wall to support the condenser;

a restraining protrusion protruding from the extensions and to penetrate the condenser; and an insertion hole opened toward the machine room opening so that the header posts are passed through the insertion hole, and wherein lower ends of the header posts are configured to be received in the insertion holes to couple the condenser to the base pan, and to be separated from the insertion holes to uncouple the condenser from the base pan.

2. The refrigerator of claim 1, wherein the base pan includes:

a bottom face; and an edge extending upwardly along a perimeter of the bottom face, and wherein the mounts protrude vertically at the edge.

3. The refrigerator of claim 1, wherein the fixing walls are positioned and curved to define the insertion holes that face the machine room opening.

4. The refrigerator of claim 3, wherein a width of the insertion holes defined by the fixing walls is less than a width of the header posts.

5. The refrigerator of claim 1, wherein each of the insertion holes is defined between the one end of the corresponding one of the fixing walls and the corresponding one of the restraining protrusions.

6. The refrigerator of claim 1, wherein restraining holes that are configured to receive the restraining protrusions therein are defined between the header posts and at least one of the fins.

7. The refrigerator of claim 6, wherein each of the restraining holes is defined within a region defined by a corresponding one of the headers, a vertically separated pair of the tubes, and one of the fins.

8. The refrigerator of claim 1, wherein a width of the restraining protrusion decreases in a protruding direction toward the machine room opening.

9. The refrigerator of claim 1, wherein the condenser is u-shaped and includes:

first and second condenser sections that are positioned to be separated from each other, wherein the header posts are positioned, respectively, at first ends of the first and second condenser sections; and a third condenser section that extends between second ends of the first and second condenser sections.

10. The refrigerator of claim 9, wherein the base pan further includes a fixing tab that is configured to be inserted into the third condenser section to restrain the condenser.

11. The refrigerator of claim 10, wherein the fixing tab is molded with the base pan, and is configured to be separated from the base pan and mounted on one side of the base pan corresponding to the third condenser section.

12. The refrigerator of claim 10, wherein the fixing tab includes:

a base plate configured to be fixedly mounted on the base pan; and a restraining wall extending from the base plate to pass into a portion of the third condenser section.

13. The refrigerator of claim 12, wherein the fixing tab includes a supporting rib that connects side faces of the restraining wall with an end of the base plate.

14. The refrigerator of claim 12, wherein a portion of the restraining wall is inserted through a fin opening defined between a vertically separated pair of the tubes and a pair of the fins extending between the pair of the tubes.

15. The refrigerator of claim 12, further comprising restraining ribs that are protruded from the base pan and configured to support respective ends of the base plate.

16. The refrigerator of claim 1, wherein a fan mount configured to receive a blowing fan to generate an air flow inside the machine room is formed on the base pan, wherein the fan mount includes a first fastener and a second fastener protruding at respective positions that are separated to define a space in which the blowing fan is received, and wherein the first fastener protrudes vertically higher than the second fastener, so that the blowing fan is configured to be received in the fan mount.

17. A home appliance comprising:

a cabinet defining a machine room;

a compressor provided in the machine room;

a machine room cover that is configured to be removably coupled to the cabinet and is configured to shield a machine room opening when coupled to the cabinet;

a base pan configured to be received in the machine room;

a condenser configured to be installed in or removed from the machine room through the machine room opening, the condenser having a first section, a second section separated from the first section and positioned further from the machine room opening than the first section, and a third section connecting first ends of the first section and the second section, the condenser including:

a first header post and a second header post provided at second ends of the first and second sections and extending in a direction intersecting the base pan;

a plurality of tubes that are vertically spaced apart and extend between the first header post and the second header post; and fins provided between adjacent pairs of the tubes;

a first mount protruding from the base pan and configured to receive a lower end of the first header post; and a second mount protruding from the base pan and configured to receive a lower end of the second header post, wherein each of the first and second mounts includes:

a fixing wall extending vertically to correspond to a circumference surface of the lower end of a corresponding one of the first and second header posts;

an extension extending from one end of the fixing wall to support the condenser;

a restraining protrusion protruding from the extensions and to penetrate the condenser; and an insertion hole opened toward the machine room opening so that the first and second header posts are passed through the insertion hole, and wherein the first header post and the second header post are configured to be inserted and mounted in the insertion holes when the condenser is moved into the machine room through the machine room opening, and are configured to move out of and be released from the insertion holes when the condenser is moved through the machine room opening to be removed from the machine room.

18. The home appliance of claim 17, wherein the first mount and the second mount protrude upwards, and are spaced apart from each other by a set distance in a horizontal direction.

19. The home appliance of claim 18, wherein the first mount is positioned closer to the machine room opening than the second mount, and the first mount extends a vertically shorter height from the base pan than the second mount.

20. The home appliance of claim 17, wherein each of the insertion holes is defined between the one end of the corresponding one of the fixing walls and the corresponding one of the restraining protrusions.

* * * * *